United States Patent [19]

Pattas et al.

[11] 3,990,239

[45] Nov. 9, 1976

[54] HOT GAS PISTON ENGINE

[75] Inventors: Konstantin Pattas, Thessaloniki, Greece; Dieter Chemnitz, Hamburg, Germany

[73] Assignee: Daimler-Benz Aktiengesellschaft, Germany

[22] Filed: Jan. 17, 1975

[21] Appl. No.: 541,950

[30] Foreign Application Priority Data

Jan. 24, 1974 Germany ..... 2403252

[52] U.S. Cl. ..... 60/519; 60/522

[51] Int. Cl.[2] ..... F02G 1/06

[58] Field of Search ..... 60/519, 525, 521, 522

[56] References Cited

UNITED STATES PATENTS

| | | | |
|---|---|---|---|
| 3,426,525 | 2/1969 | Rubin | 60/519 |
| 3,525,215 | 8/1970 | Conrad | 60/519 X |
| 3,751,904 | 8/1973 | Rydberg | 60/525 |
| 3,762,167 | 10/1973 | Wahnschaffe et al. | 60/519 |
| 3,763,649 | 10/1973 | Wahnschaffe et al. | 60/519 |
| 3,800,526 | 2/1974 | Wahnschaffe et al. | 60/519 |
| 3,811,283 | 5/1974 | Hartmann et al. | 60/525 |

*Primary Examiner*—Allen M. Ostrager
*Attorney, Agent, or Firm*—Craig & Antonelli

[57] ABSTRACT

A hot gas piston engine with an output control which is realized by changing the working medium quantity participating in the working process and with at least one working system, to the working volume of which is coordinated an auxiliary system, in which prevails a higher pressure than the minimum working pressure; the working system is intermittently connected with the auxiliary volume at most over a part of each working cycle, whereby the connection to the auxiliary volume is variable both as regards opening cross section as also opening duration.

25 Claims, 3 Drawing Figures

HOT GAS PISTON ENGINE

The present invention relates to a hot gas piston engine with a power output control by changing the working medium quantity participating in the working process and with at least one working system, to the working volume of which is coordinated an auxiliary volume, in which prevails a higher pressure than the minimum working pressure.

With the prior art power output controls for hot gas engines which are controlled by the change of the working medium quantity participating in the working process, above all the structural expenditures are considerable, and it is therefore the aim of the present invention to provide a control installation which operates with considerably reduced structural expenditures and which is at least equivalent to the known system as regards the inertia of the control and the power losses connected with the control system.

According to the present invention, this is attained in a hot gas piston engine of the aforementioned type in that the working system is intermittently connected with the auxiliary volume at most over a portion of each working cycle and in that the connection to the auxiliary volume is variable both as regards the opening cross section as also as regards the opening duration. A pressure equalization is effected by the exchange in working medium quantity, i.e., in mass, which takes place during the time of the connection between the working system and the auxiliary volume, which has as a consequence a reduction of the power output, whereby this reduction is to be controlled in a simple manner by a change of the opening cross section and of the opening duration. The losses connected therewith as also the inertia of the control are slight because a complete pressure equalization exists from the beginning of the opening to the end of the opening of the connecting cross section. The structural expenditure is comparatively slight with the control according to the present invention in which the pressure equalization effects a deformation of the PV-diagram dependent on the opening duration, because the solution according to the present invention makes it possible by reason of the changes realizable as regards the opening cross section and opening duration, to get along with only a single auxiliary volume and to maintain always a pressure in the auxiliary volume without the use of compressors, which is higher than the minimum working pressure so that the return of working medium quantity into the working system, which is necessary for raising the output, is possible without auxiliary medium or means.

In one embodiment of the present invention, it is appropriate if the auxiliary volume is coordinated, respectively, to the cold working space of the working volume because in this manner both the working medium quantity to be exchanged, and therewith the auxiliary volume as also the inertia of the control system and the output losses connected therewith can be kept small.

The solution according to the present invention has a particularly favorable effect on hot gas piston engines with several working systems operating with phase displacement because in this case according to the present invention one common auxiliary volume can be coordinated respectively to at least two working systems.

It is appropriate therefor in particular if there is coordinated to the respective cold-working space of one working system which is in the compression phase, a cold-working space of another working system which is in the expansion phase, as component of the auxiliary volume. The connection to the auxiliary volume is to be variable within the scope of the present invention both as regards the opening cross section as also as regards the opening duration. This can be achieved in a particularly simple manner if the opening cross section leading to the auxiliary volume is valved by the piston of the engine. A closure element, in particular, a slide valve member or the like, is thereby coordinated to the opening cross section leading to the auxiliary volume by means of which the cross section is adjustable depending on the position and opening duration.

Accordingly, it is an object of the present invention to provide a hot gas piston engine which avoids by simple means the aforementioned shortcomings and drawbacks encountered in the prior art.

Another object of the present invention resides in an output control for hot gas engines which is relatively uncomplicated and inexpensive, yet entails no disadvantages as regards inertia of the control and output losses connected therewith.

A further object of the present invention resides in an output control for hot gas piston engines which can be realized by considerably more simple means and fewer structural expenditures than possible heretofore.

Still another object of the present invention resides in a hot gas piston engine of the type described above in which both the opening cross section as well as the opening duration can be adjustably controlled by extremely simple means.

These and further objects, features and advantages of the present invention will become more apparent from the following description when taken in connection with the accompanying drawing which shows, for purposes of illustration only, two embodiments in accordance with the present invention, and wherein.

Figure 1:
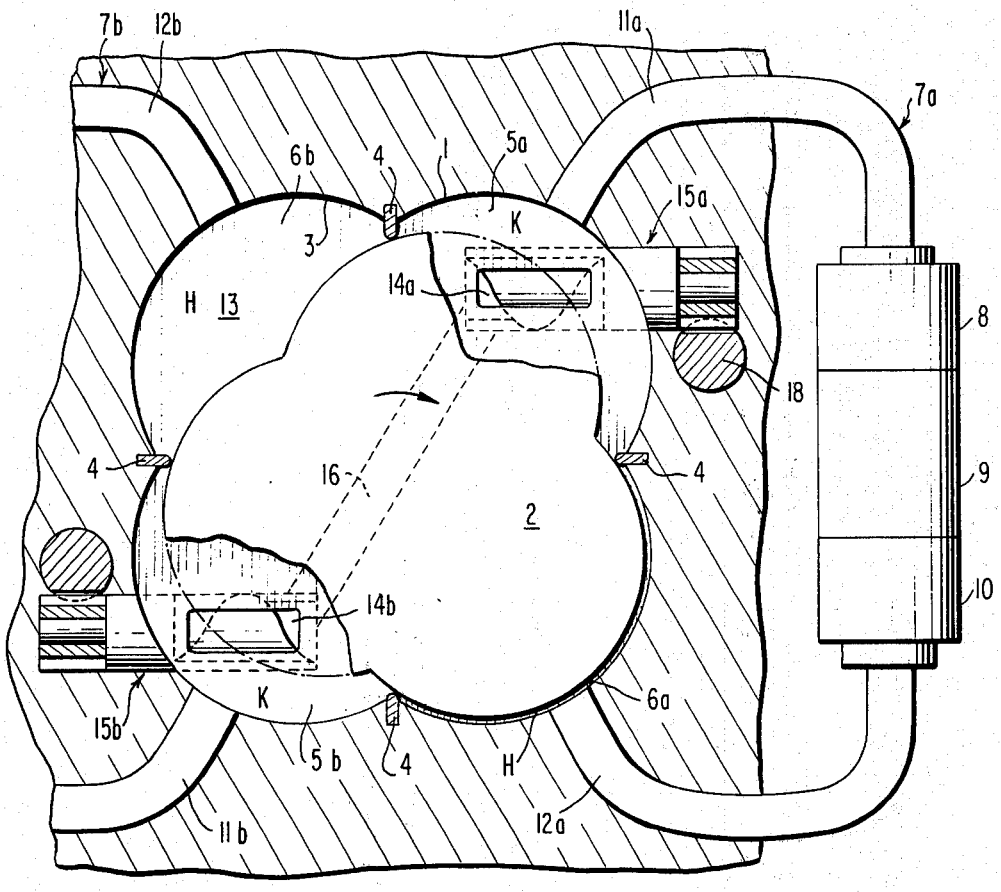
FIG. 1 is a schematic cross-sectional view through a hot gas piston engine constructed as rotary piston engine in accordance with the present invention with at least one closure element provided in a lateral disk, by way of which the connection to an auxiliary volume can be varied both as regards opening cross section as also as regards its opening duration.

Referring now to the drawing wherein like reference numerals are used throughout the various views to designate like parts, the hot gas piston engine which is illustrated in FIG. 1 in a schematic cross sectional view and which is constructed as rotary piston engine, includes as external envelope a four-arched casing housing 1 which is arranged fixedly and in which rotates an epitrochoidally constructed three-arched piston 2. The piston 2 and an eccentric shaft (not illustrated) on which the piston 2 is supported, rotate in opposite directions, whereby the eccentric shaft rotates three times as fast as the piston 2. Four sealing bars 4 are provided at the circumference of the running surface 3 of the casing housing 1, coordinated to the constrictions thereof, which sealing bars, together with a section of the piston, delimit respectively a working chamber, whereby of the four chambers present in the illustrated embodiment, respectively diagonally mutually opposite chambers have the same function and serve as cold-working spaces 5*a* and 5*b* and as hot-working spaces 6*a* and 6*b*. The working spaces 5*a*, 6*a* and 5*b*, 6*b* belonging to a respective working system are connected with each other by way of a line system 7*a* and 7*b*, respectively, in which, in relation to the direction of passing from the cold working space 5*a* or 5*b* to the hot working space 6*a* or 6*b*, there are arranged a cooler 8, a regenerator 9, and a heater 10. The line system 7*a* and 7*b* is connected in the illustrated embodiment with the casing housing 1 by way of line sections 11*a*, 12*a* and 11*b*, 12*b* which terminate in the running surface 3.

Apertures 14*a* and 14*b* are provided in the lateral disk 13 of the engine, visible in plan view, in the schematic illustration according to FIG. 1 which are coordinated respectively to the cold-working space 5*a* and 5*b* and are valved by the piston 2. A closure element generally designated by reference numeral 15*a* and 15*b* is coordinated to the corresponding aperture 14*a* and 14*b*, the apertures 14*a* and 14*b* being connected with each other by way of a channel 16.

Figure 2:
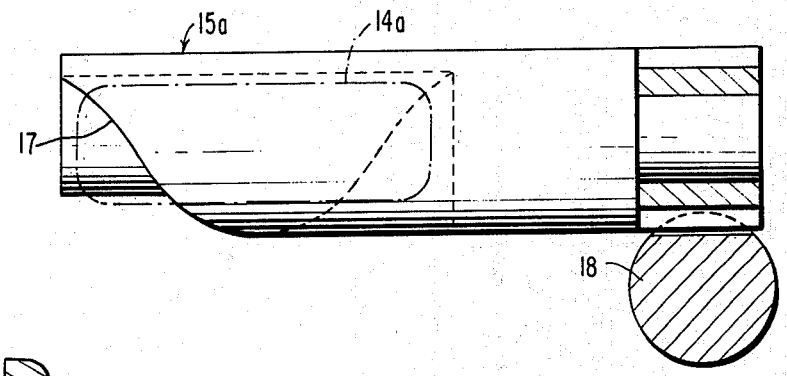
FIG. 2 is a somewhat schematic elevational view, on an enlarged scale, of a rotary slide valve member used in FIG. 1 and serving as closure element.

In the embodiment according to FIG. 1, rotary slide valves are used as closure elements 15*a* and 15*b*, as also illustrated on an enlarged scale in FIG. 2, which are offset in their areas coordinated to the apertures 14*a* and 14*b* over a part of their circumference with respect to their full diameter, whereby helically shaped control edges 17 are provided at the rotary slide valve members 15*a* and 15*b*. The rotation of the rotary slide valve members serving as closure elements 15*a* and 15*b* takes place respectively by a toothed rack 18, and within the scope of the present invention appropriately a common actuating mechanism of conventional type is coordinated to these toothed racks 18. By reason of the helically shaped configuration of the control edge 17, each rotation of the closure element 15*a* and 15*b* in its construction as rotary slide valve produces variations or changes in the free opening cross section of the apertures 14*a*, 14*b* in dependence upon the position of the control edge at a given instance. By virtue of the varying of the free-opening cross-section, the opening duration between the working spaces connected with each other is varied or changed since a larger free-opening cross-section of the apertures 14*a*, 14*b* will naturally remain open longer than a smaller free-opening cross-section. Thus when, the working space 5*a* is in the compression phase, the working space 5*b* passes through the expansion phase and is able to receive additional volume out of the working space 5*a*.

The working space 5*b* then operates together with the channel 16 as auxiliary volume. Of course, it would also be possible to coordinate a separate auxiliary volume to each of the working spaces which, however, would have as a consequence an increased space requirement.

Figure 3:
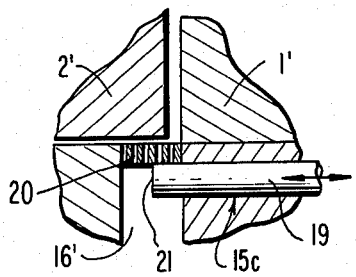
FIG. 3 is a partial schematic cross sectional view of a further embodiment of a closure element according to the present invention which is located in the connection to the auxiliary volume.

In the embodiment according to FIG. 3, a slide valve 19 is provided as linearly displaceable closure element generally designated by reference numeral 15*c*, by means of which the opening cross section of the connecting channel designated by reference numeral 16′ in analogy to FIG. 1 can be adjusted, whereby in conjunction with the valving of the aperture coordinated to the channel 16′ by the piston 2′, a change in the opening duration results simultaneously. A lattice-like or grid-like element 20 is inserted into the aperture which connects the channel 16′ with the interior space enclosed by the housing casing 1′; the element 20 includes lattice-like or grid-like webs extending at least approximately parallelly to the front edge 21 of the slide valve member 19 in order to obtain with the adjustment of the opening cross section simultaneously also a change of the opening duration. With a slide valve member 19 set back with respect to the lateral boundary plane of the housing interior space, in which is disposed the aperture coordinated to the channel 16′, the opening cross section would change with the adjustment of the slide valve member 19 as can be readily seen from the drawing, but the opening duration would remain the same without the use of such a lattice-like or grid-like element.

While we have shown and described two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A hot gas piston engine with an output control means by changing the working medium quantity participating in the working process, which includes at least one working system and an auxiliary volume means coordinated to the working volume of said working system, a higher pressure prevailing in said auxiliary volume means than the minimum working pressure, characterized in that the working system is intermittently connected with the auxiliary volume means at most over a part of each working cycle, and means for varying the connection to the auxiliary volume means both as regards opening cross section as also as regards opening duration.

2. A hot gas piston engine according to claim 1, characterized in that the auxiliary volume means is coordinated respectively to the cold working space of the working volume.

3. A hot gas piston engine according to claim 2, with several working systems operating with phase displacement, characterized in that a common auxiliary volume means is coordinated to the working systems.

4. A hot gas piston engine according to claim 3, characterized in that a cold working space of one working system which is in the expansion phase is coordinated respectively to the working space of another working system which is in the compression phase, as component of the auxiliary volume means.

5. A hot gas piston engine according to claim 4, characterized in that the opening cross section leading to the auxiliary volume means is valved by the piston of the engine.

6. A hot gas piston engine according to claim 5, characterized in that the opening cross section leading to the auxiliary volume means is adjustable by a closure means.

7. A hot gas piston engine according to claim 6, characterized in that the closure means is a rotary slide valve.

8. A hot gas piston engine according to claim 6, characterized in that for a hot gas engine with several working systems, the auxiliary space is so connected that all systems are connected with each other and with said one auxiliary space.

9. A hot gas piston engine according to claim 1, with several working systems operating with phase displacement, characterized in that a common auxiliary volume means is coordinated to the working systems.

10. A hot gas piston engine according to claim 9, characterized in that a cold working space of one working system which is in the expansion phase is coordinated respectively to the working space of another working system which is in the compression phase, as component of the auxiliary volume means.

11. A hot gas piston engine according to claim 1, characterized in that the opening cross section leading to the auxiliary volume means is valved by the piston of the engine.

12. A hot gas piston engine according to claim 1, characterized in that the opening cross section leading to the auxiliary volume means is adjustable by a closure means.

13. A hot gas piston engine according to claim 12, characterized in that the closure means is a rotary slide valve.

14. A hot gas piston engine according to claim 1, characterized in that for a hot gas engine with several working systems, the auxiliary space is so connected that all systems are connected with each other and with said one auxiliary space.

15. A hot piston gas engine according to claim 7, characterized in that said rotary slide valve includes a control edge for varying the opening cross-section, said control edge having a helically-shaped configuration.

16. A hot gas piston engine according to claim 12, characterized in that the closure means is a linearly displaceable closure element.

17. A hot piston gas engine according to claim 16, with several working systems operating with phase displacement, characterized in that a common auxiliary volume means is coordinated to the working systems.

18. A hot gas piston engine according to claim 17, characterized in that a cold working space of one working system which is in the expansion phase is coordinated respectively to the working space of another working system which is in the compression phase as component of the auxiliary volume means.

19. A hot gas piston engine according to claim 16, characterized in that the auxiliary volume means is coordinated respectively to the cold working space of the working volume.

20. A hot gas piston engine according to claim 1, characterized in that said means for varying the connection to the auxiliary volume means both as regards opening cross-section and as also regards opening duration includes at least one grid-like member arranged at the auxiliary volume means, and a closure means is provided for cooperating with said grid-like member.

21. A hot gas piston engine according to claim 20, characterized in that said grid-like member is arranged at the opening cross-section leading to the auxiliary volume means.

22. An arrangement according to claim 21, characterized in that the closure means is a linearly displaceable closure element.

23. An arrangement according to claim 22, characterized in that grid-like member includes a plurality of interconnected webs extending at least approximately parallel to a front edge of said linearly displaceable closure element.

24. An arrangement according to claim 23, characterized in that the auxiliary volume means is coordinated respectively to the cold working space of the working volume.

25. An arrangement according to claim 23, with several working systems operating with phase displacement, characterized in that a common auxiliary volume means is coordinated to the working systems.

* * * * *